US007028426B1

(12) United States Patent
Viani

(10) Patent No.: US 7,028,426 B1
(45) Date of Patent: Apr. 18, 2006

(54) ACCESSORY RAIL TRIGGER GUARD HOLSTER

(76) Inventor: Arthur Viani, 12219 SW. 131 Ave., Miami, FL (US) 33186

( * ) Notice: Subject to any disclaimer, the term of this patent is extended or adjusted under 35 U.S.C. 154(b) by 0 days.

(21) Appl. No.: 10/996,941

(22) Filed: Nov. 26, 2004

(51) Int. Cl.
*F41A 17/00* (2006.01)
*F41C 33/00* (2006.01)

(52) U.S. Cl. ..... 42/70.07; 224/193

(58) Field of Classification Search ..... 224/193, 224/912, 198, 243; 42/70.07
See application file for complete search history.

(56) References Cited

U.S. PATENT DOCUMENTS 1,166,781 A * 1/1916 Parrish ..... 224/193
5,419,472 A 5/1995 Hellweg et al. ..... 224/198
5,622,295 A 4/1997 Hellweg et al. ..... 224/193
5,865,357 A 2/1999 Goodwin ..... 224/587

* cited by examiner

*Primary Examiner*—Michael J. Carone
(74) *Attorney, Agent, or Firm*—Albert Bordas

(57) ABSTRACT

A trigger guard holster comprising a combination clip holster and trigger guard assembly that mounts upon an existing accessory rail of a firearm. The trigger guard assembly has guard walls to prevent the accidental firing of a firearm when the firearm is worn with the clip holster in a person's waistband. The trigger guard assembly also protects the person by preventing the trigger from unintended contact with objects, which would cause unintentional or accidental firing of the firearm when carried or used.

7 Claims, 5 Drawing Sheets

Fig 4
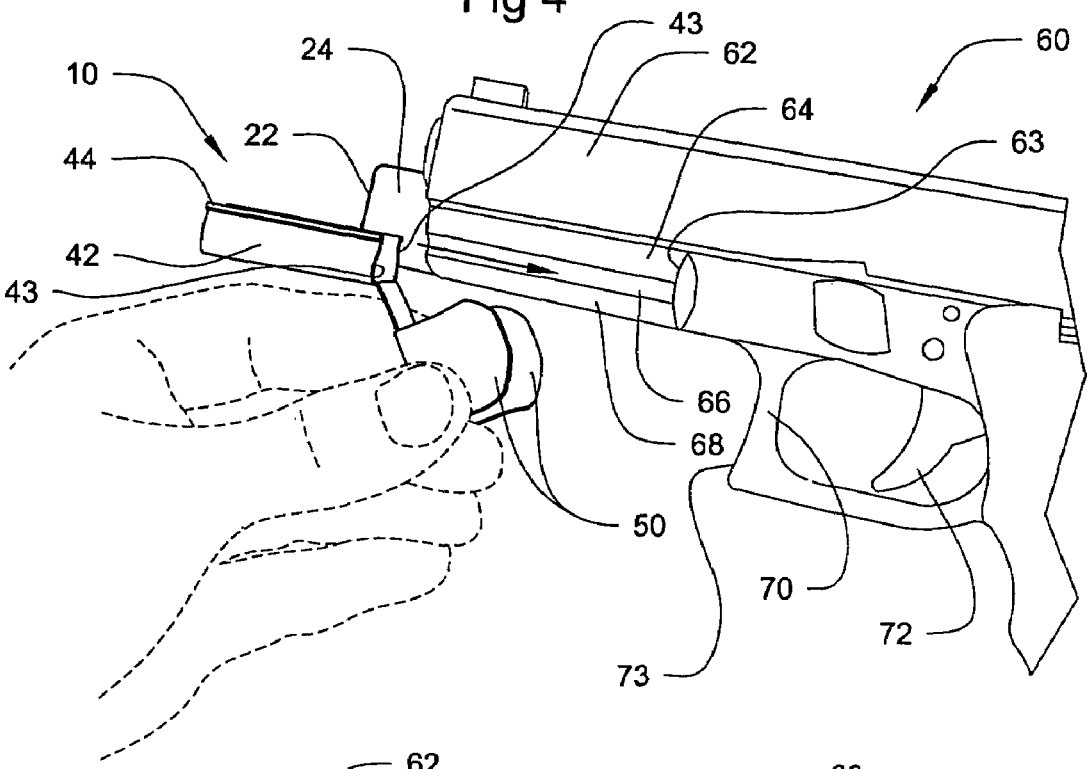
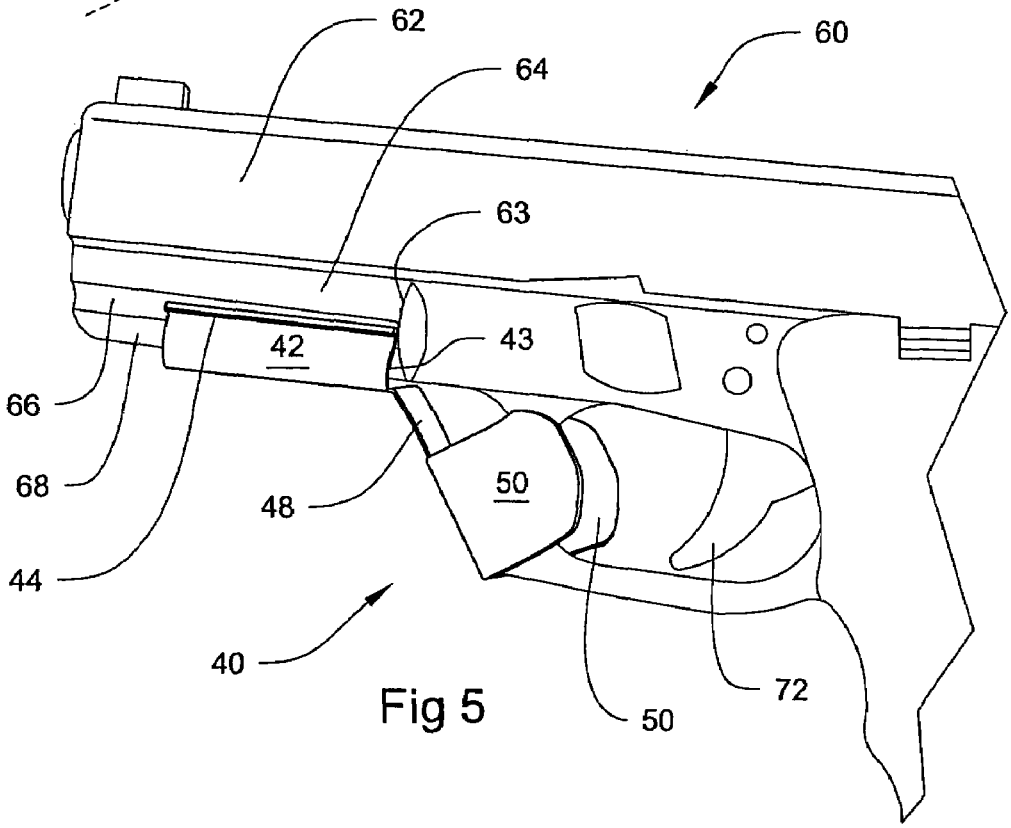
Fig 5

ACCESSORY RAIL TRIGGER GUARD HOLSTER

BACKGROUND OF THE INVENTION

1. Field of the Invention

The present invention relates to trigger guards, and more particularly, relates to a trigger guard that mounts upon a firearm's accessory rail and serves as a clip holster.

2. Description of the Related Art

Trigger guards have been used to prevent the accidental discharge of firearms. Clip holsters have been used as a method of holding a firearm on one's person. There are many varieties of dip holsters. Some are integral to the grip stocks of a firearm, and others utilize pins and screws to attach the clip holster to the firearm. These methods are adequate, but require the addition of parts that may affect the performance of the firearm. Furthermore, these types of clip holsters are not readily installable or removable. More importantly however, there is a history of these types of dip holsters that permit a firearm to fire when worn by the person in their intended manner, inside the person's waistband.

Several designs for trigger guards have been designed in the past. However, there are no combination trigger guard and clip holster that attach to the accessory rails of a firearm, and that can be carried safely in their intended manner without the danger of unintentional or accidental discharge of the firearm. Furthermore, are readily installable and removable, and require no tools to install or remove.

Applicant believes that the closest reference corresponds to U.S. Pat. No. 5,419,472 issued to Hellweg, et al. for Holster for guns or the like on May 30, 1995. However, it differs from the present invention because Hellweg, et al. does not teach the use of a gun's accessory rails. Hellweg, et al. teaches a holster for a gun comprising a pouch for receiving the gun. The pouch being mounted on a belt-receiving member; the belt-receiving member having an elongate slot therein, the pouch being mounted to the belt-receiving member by a fastener passing through the elongate slot the fastening being able to be selectively released to allow the pouch to be moved axially relative to the belt-receiving member by moving the fastening along the slot, and the pouch being able to be rotated about the fastening.

Applicant believes that another reference corresponds to U.S. Pat. No. 5,865,357 issued to Goodwin for Belt clip for concealed container on Feb. 2, 1999. However, it differs from the present invention because Goodwin does not teach the use of a firearm's accessory rails. Goodwin teaches a belt clip for holding a container, such as a firearm holster, inside the waistband of a pair of pants includes a straight member, a top hook member and a bottom hook member. The hook members hold the top and bottom, respectively, of a belt worn by a user. A gap between the hook members allows the belt clip and container to be attached and removed from the belt while the belt is being worn. The belt clip may be adjustable to accommodate different sized belts.

Applicant believes that another reference corresponds to U.S. Pat. No. 5,622,295 issued to Hellweg, et al. for Holster for handguns or the like on Apr. 22, 1997. However, it differs from the present invention because Hellweg, et al. does not teach the use of a gun's accessory rails. Hellweg, et al. teaches a holster for a handgun comprising a holster body for receiving the handgun. The holster body being mounted on a belt receiving member; the holster body having an open top for receiving the handgun and an open bottom to allow a barrel of the handgun to project therethrough if required; the holster body is of a folded construction having two substantially parallel but spaced apart ends shaped to conform with the barrel and/or slide of the handgun to define an open side therebetween, there being provided at least one adjustable tension means passing between the ends and across the open side to retain the ends in a desired but adjustable spaced, relationship.

Other patents describing the closest subject matter provide for a number of more or less complicated features that fail to solve the problem in an efficient and economical way. None of these patents suggest the novel features of the present invention. More specifically, none of these patents suggest use of an existing firearm's accessory rail for mounting of a trigger guard holster.

SUMMARY OF THE INVENTION

The instant invention utilizes preexisting accessory rails of a firearm. It is readily removable and does not affect the function of the firearm.

The instant invention has integral trigger guards defined as guard walls. The guard walls prevent the accidental firing of the firearm when the firearm is worn with the clip holster in the person's waistband.

More specifically, the instant invention is a trigger guard holster for a firearm, comprising a clip holster and a trigger guard assembly. The trigger guard assembly has means for removably mounting the trigger guard assembly upon an accessory rail of a firearm. The accessory rail comprises two elongated channels to cooperatively receive the trigger guard assembly.

The clip holster has first and second walls joined by a bend forming a first U shape, and the trigger guard assembly has third and fourth walls joined by a base wall forming a second U shape. The third wall extends from the first wall. The trigger guard assembly further comprises a mount wall extending at a predetermined angle from the base wall. The mount wall has first and second guard walls extending perpendicularly therefrom a predetermined distance. The first and second guard walls are shaped with curvature wherein they curve slightly outwardly away from each other to cover a trigger of the firearm when the trigger guard assembly is mounted onto the accessory rail of the firearm. The first and second walls possesses a first spring tension between them to allow the clip holster to expand and contract providing a first resistive tension so that a first degree of force is necessary to place the clip holster on a waistband. The third and fourth walls possesses a second spring tension between them to allow the trigger guard assembly to expand and contract providing a second resistive tension so that a second degree of force is necessary to mount the trigger guard assembly on the accessory rail of the firearm.

In the preferred embodiment, the clip holster and the trigger guard assembly are approximately 1–15 mm in thickness and the firearm is a pistol.

It is therefore one of the main objects of the present invention to provide an accessory rail trigger guard holster to protect the user by preventing the trigger from unintended contact with objects, which would cause unintentional or accidental firing of the firearm when carried or used.

It is another object of this invention to provide an accessory rail trigger guard holster that mounts upon the accessory rail, enabling a person to carry a firearm safely inside a waistband or attached to an object without the danger of an unintentional or accidental discharge.

It is another object of this invention to provide an accessory rail trigger guard holster that provides a trigger guard assembly that attaches to the accessory rail of a firearm.

It is yet another object of this invention to provide an accessory rail trigger guard holster that is readily installable and removable, requires no additional parts for it to function or tools to install or remove.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 illustrates a left perspective view of the instant invention aligned and being introduced to the accessory rail of the firearm.

FIG. 5 illustrates a left perspective view of the instant invention mounted onto the accessory rail of the firearm.

DETAILED DESCRIPTION OF THE PREFERRED EMBODIMENT

Figure 1:
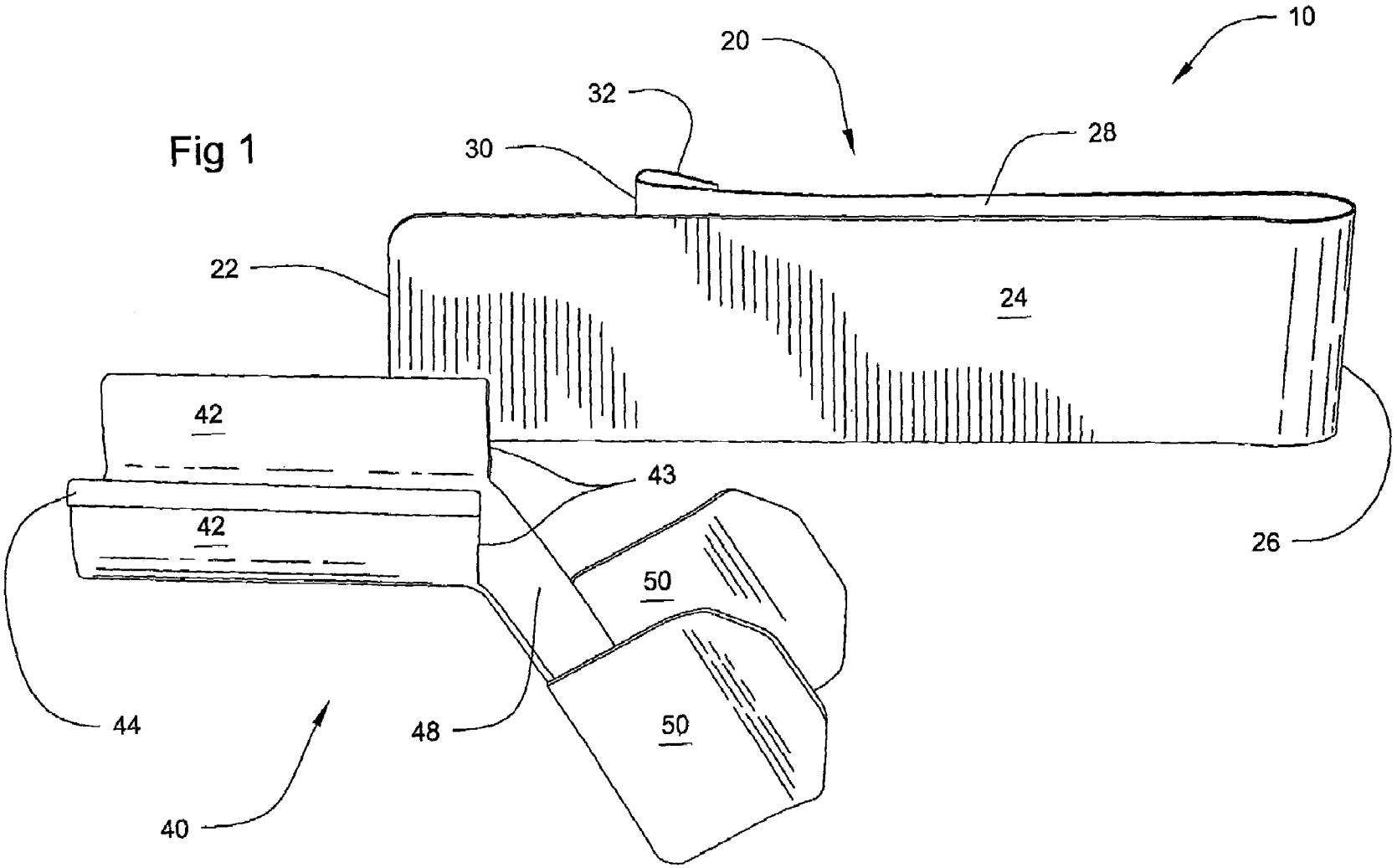
FIG. 1 represents a left perspective view of the instant invention.

Referring now to the drawings, where the present invention is generally referred to with numeral 10, it can be observed that it basically includes clip holster 20 and trigger guard assembly 40.

Figure 2:
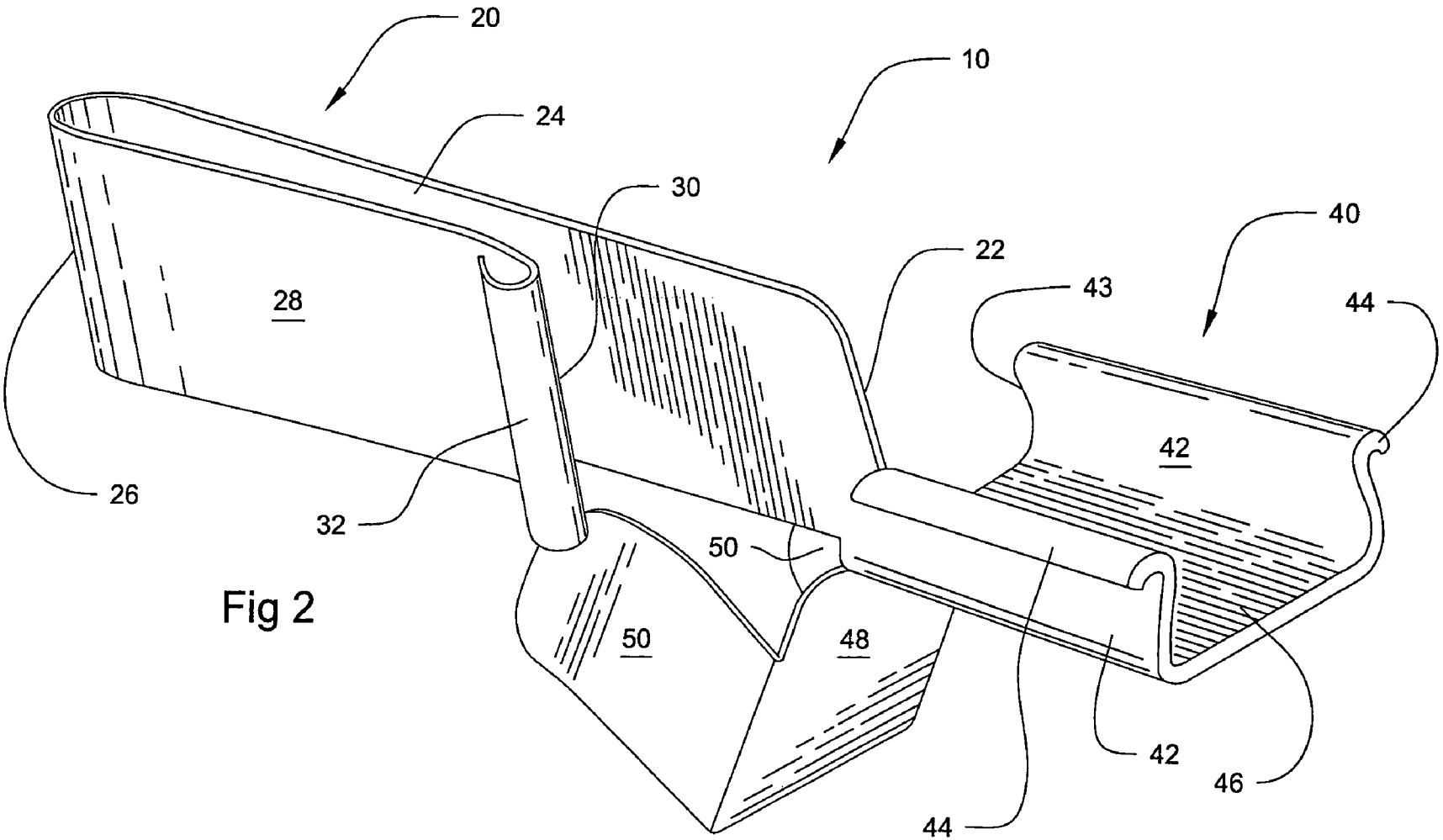
FIG. 2 shows a right perspective view of the instant invention.

As seen in FIGS. 1 and 2, clip holster 20 comprises straight-arm 24 and tension arm 28 generally parallel to one another and joined at bend 26. Straight-arm 24 terminates at end 22 and tension arm 28 terminates at lip 32 that has a bend 30.

As better seen in FIG. 2, extending from clip holster 20, and more specifically straight-arm 24, is trigger guard assembly 40. Trigger guard assembly 40 comprises parallel and spaced apart sidewalls 42 extending from base wall 46. Sidewalls 42 terminate with lips 44. It is noted that sidewalls 42 incline slightly towards each other, wherein the distance between sidewalls 42 at base wall 46 is slightly greater than the distance between lips 44.

Extending at a predetermined angle from base wall 46 is mount wall 48. Perpendicularly extending at a second predetermined angle from mount wall 48 are spaced apart guard walls 50. It is noted that guard walls 50 have some curvature wherein they curve slightly outwardly away from each other.

Figure 3:
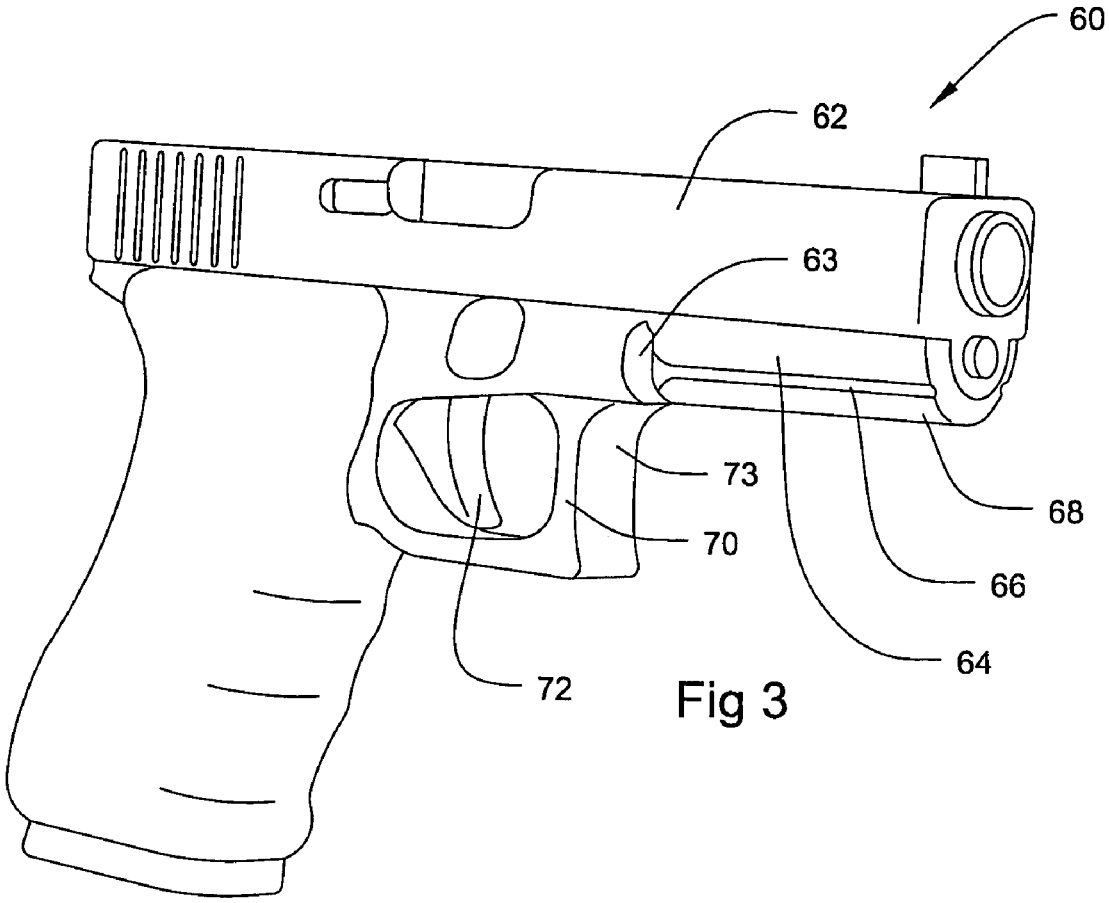
FIG. 3 illustrates a perspective view of a firearm comprising an accessory rail.

Seen in FIG. 3 is a firearm defined as pistol 60. Pistol 60 may be, but is not limited to, firearms manufactured by "BERFTTA", "GLOCK", "SIG ARMS", "COLT", "KIMBER", "H&K", "SMITH & WESSON", "SPRINGFIELD ARMORY", or any other firearm with accessory rails to mount objects and/or accessories thereon. Pistol 60 comprises slide 62. Below slide 62 are dustcover sidewalls 64, channels 66, and rail 68, all of which define an accessory rail area or dustcover. Pistol 60 further comprises trigger guard 70 and trigger 72.

As seen in FIGS. 4 and 5, to mount instant invention 10 upon pistol 60, lips 44 are aligned with channels 66. It is noted that channels 66 have cooperative characteristics to receive lips 44. In addition, it is noted that the width between lips 44 may be smaller than the width between channels 66. In the preferred embodiment, trigger guard assembly 40 possesses a spring tension between lips 44 to allow the trigger guard assembly 40 to expand and contract between lips 44. This provides resistive tension so that a degree of force is necessary to mount the trigger guard assembly 40 onto channels 66 and remove it. Once lips 44 are aligned with channels 66, instant invention 10 is snugly slid along channels 66 until edges 43 make contact with face 63 and/or until any section of mount wall 48 makes contact with face 73. In the preferred embodiment, edges 43 make contact with face 63 and mount wall 48 makes contact with face 73.

Figure 6:
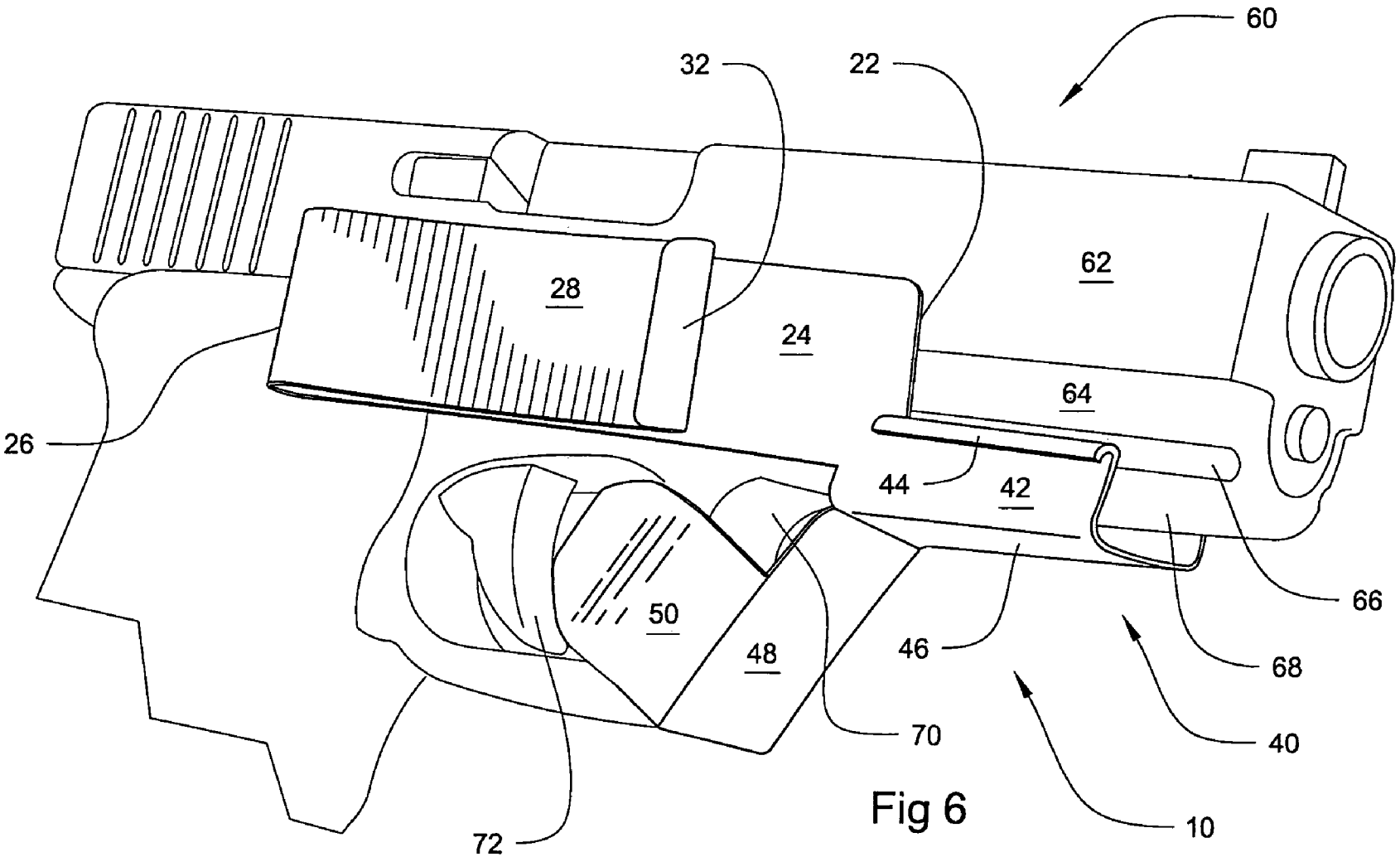
FIG. 6 illustrates a right perspective view of the instant invention mounted onto the accessory rail of the firearm.

As seen in FIG. 6, instant invention 10 is mounted upon pistol 60. In the illustrated embodiment guard walls 50 block an area around trigger 72, thereby preventing the trigger 72 from unintended contact with objects, which would cause unintentional or accidental firing of the firearm when carried or used. As previously mentioned, guard walls 50 have some curvature wherein they curve slightly outwardly away from each other. This outward curved design is to prevent the trigger 72 from unintended contact with objects. In addition, the outward curved design also allows emergency access of a user's trigger finger to trigger 72. This allows the user to fire pistol 60 in the event that instant invention 10 inadvertently remains mounted on pistol 60.

Figure 7:
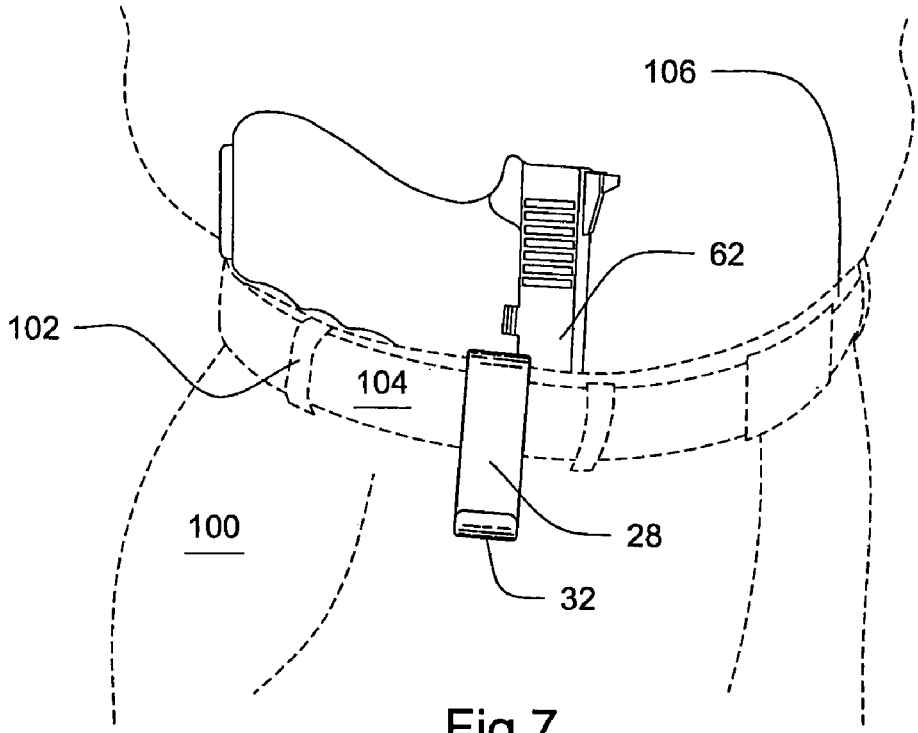
FIG. 7 illustrates the instant invention mounted onto the accessory rail of the firearm and secured onto the waistband of a user.

As seen in FIG. 7, clip holster 20 is attached to pistol 60, supporting it and allowing it to be carried on one's person utilizing the clip tension arm 28, which interfaces with their clothing. In this illustration clothing may include pant 100 having belt loops 102 and a waistband 106. Belt 104 is optional but may assist in keeping waistband 106 near a constant area of the waist of the person. Belt 104 may also be replaced with other support means such as, but not limited, to suspenders, straps typically worn over the shoulders of a person to support pant 100 or trousers. Obviously, besides pant 100, clothing may also include short pants, shorts, or other material that covers the lower torso of a human being.

In the preferred embodiment, the clip holster 20 possesses a spring tension between straight-arm 24 and tension arm 28 to allow the clip holster 20 to expand and contract linearly. This provides resistive tension so that a degree of force is necessary to place the clip holster 20 on the belt 104 and/or waistband 106 and remove it.

Instant invention 10 may be manufactured of a durable, metallic or plastic material. In the preferred embodiment, Instant invention 10 is approximately 1–15 mm in thickness.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

The invention claimed is:

1. A trigger guard holster for a firearm, comprising:

A) a clip holster; and

B) a trigger guard assembly with means for removably mounting said trigger guard assembly upon an accessory rail of a firearm, said trigger guard assembly preventing access to a trigger of said firearm, said accessory rail comprising two elongated channels to cooperatively receive said trigger guard assembly.

2. The trigger guard holster for a firearm according to claim 1, further characterized in that said clip holster has first and second walls joined by a bend forming a first U shape, and said trigger guard assembly has third and fourth walls joined by a base wall forming a second U shape.

3. The trigger guard holster for a firearm according to claim 2, further characterized in that said third wall extends from said first wall, said trigger guard assembly further comprising a mount wall extending at a predetermined angle from said base wall, said mount wall having first and second guard walls extending perpendicularly therefrom a predetermined distance, said first and second guard walls shaped with curvature wherein they curve slightly outwardly away from each other to cover a trigger of said firearm when said trigger guard assembly is mounted onto said accessory rail of said firearm.

4. The trigger guard holster for a firearm according to claim 3, further characterized in that said first and second walls possesses a first spring tension between them to allow said clip holster to expand and contract providing a first resistive tension so that a first degree of force is necessary to place said clip holster on a waistband.

5. The trigger guard holster for a firearm according to claim 4, further characterized in that said third and fourth walls possesses a second spring tension between them to allow said trigger guard assembly to expand and contract providing a second resistive tension so that a second degree of force is necessary to mount said trigger guard assembly on said accessory rail of said firearm.

6. The trigger guard holster for a firearm according to claim 5, further characterized in that said clip holster and said trigger guard assembly are approximately 1–15 mm in thickness.

7. The trigger guard holster for a firearm according to claim 6, further characterized in that said firearm is a pistol.

* * * * *